United States Patent [19]

Broverman

[11] 4,108,688

[45] Aug. 22, 1978

[54] CAST ALUMINUM PLATE AND METHOD THEREFOR

[75] Inventor: Irwin Broverman, Livermore, Calif.

[73] Assignee: Kaiser Aluminum & Chemical Corporation, Oakland, Calif.

[21] Appl. No.: 728,366

[22] Filed: Sep. 30, 1976

[51] Int. Cl.[2] ..... C22F 1/04; C22C 21/08

[52] U.S. Cl. ..... 148/3; 75/141; 75/142; 75/146; 75/147; 148/32

[58] Field of Search ..... 148/3, 2, 11.5 A, 32, 148/32.5; 75/141, 142, 146, 147

[56] References Cited

U.S. PATENT DOCUMENTS 3,347,714 10/1967 Broverman et al. ..... 148/11.5 A

*Primary Examiner*—R. Dean

*Attorney, Agent, or Firm*—Paul E. Calrow; Edward J. Lynch

[57] ABSTRACT

This invention is directed to the formation of massive aluminum-magnesium alloy plate wherein the plate is cast directly to size then homogenized at a temperature greater than 1020° F for more than 12 hours to provide good mechanical properties and excellent weldment characteristics.

16 Claims, No Drawings

CAST ALUMINUM PLATE AND METHOD THEREFOR

BACKGROUND OF THE INVENTION

The invention generally relates to the fabrication of massive Al-Mg alloy plate greater than 6 inches thick, and particularly such plate 8 inches thick or greater. All numbered alloy designations herein refer to Aluminum Association alloy designations, and all percentage compositions herein are weight per cent unless noted otherwise.

Heretofore, most commercially produced aluminum plate has been fabricated in thicknesses less than 5 inches. Conventional fabrication procedures generally comprised casting the alloy into a rolling ingot about 10–24 inches thick, homogenizing the ingot and then hot rolling the ingot to the desired thickness. When properly degassed and thermally treated, the quality of the plate produced by these procedures was generally excellent.

With the advent of large LNG tankers, such as described in U.S. Pat. No. 3,680,323, aluminum plate greater than ≡inches thick was needed for the equatorial ring (interface structure 72 shown in FIG. 7 of the aforesaid patent). The ring is machined from the thick plate to the final shape.

The metal quality requirements for the equatorial ring are quite stringent because the entire tank and its contents are supported by this element which is critical to the basic design concept of leak-before-failure. Aluminum alloy 5083 was selected for this application because of its excellent weldability, excellent mechanical properties, such as strength, ductility, fracture toughness and fatigue crack growth rate and excellent cryogenic physical properties. The minimum tensile properties for 0 temper (full anneal) normally specified are as follows:

| Direction Location* | Longitudinal ¼ t | | Long Transverse ¼ t | | Short Transverse ½ t | |
|---|---|---|---|---|---|---|
| Units | ksi | kp/mm² | ksi | kp/mm² | ksi | kp/mm² |
| Tensile strength min. | 37.0 | 26.0 | 37.0 | 26.0 | 35.0 | 24.5 |
| Yield strength min. (0.2% offset) | 15.0 | 10.5 | 15.0 | 10.5 | 15.0 | 10.5 |
| Elongation, min. (2" or 4D) | 14% | | 12% | | 10% | |

*In accordance with ASTM provisions for tensile testing heavy plate

When fabricating the 5083–0 plate, greater than 5 inches thick, particularly greater than 6 inches, in accordance with conventional procedures, it was found that the one-fourth *t* properties in the longitudinal and long transverse directions readily met minimum requirements, but the one-half *t* short transverse (ST) properties could fail the minimum specified properties, particularly as to tensile strength and elongation. Occasionally, ST tensile strengths were as low as 30,000 psi and ST elongation was as low as 3%. The plate frequently failed to meet the Aluminum Association ultrasonic test requirements for Class C discontinuity limits, the least stringent class.

It was apparent that thick plate could be formed by casting an ingot directly to the desired plate size rather than trying to hot roll a thicker ingot down to the desired size. However, it was found that although the mechanical properties of "as-cast" 5083 ingot conventionally homogenized (i.e. 950° for 24 hours) fully met all the minimum tensile requirements set forth above, including short transverse property requirements, butt weldments of conventionally homogenized cast-to-size 5083 plate had unacceptable properties. The weldments met minimum ASME tensile specifications, but they consistently failed to meet bend test requirements ($3\frac{1}{3}$ *t* radius). Failure of the bend test indicates an unacceptable weldment.

It is against this background that the present invention was developed.

DESCRIPTION OF THE INVENTION

The invention is directed to a method of forming massive Al-Mg alloy plate at least 6 inches thick and is particularly directed to the formation of thick plate from aluminum alloys containing about 3–6.0% magnesium.

In accordance with the present invention, the Al-Mg alloy is D.C. cast directly into the desired dimensions of the thick plate. The cross section of the ingot can be of any desired shape, such as square, rectangular or trapezoidal. The trapezoidal shape is particularly attractive in fabricating thick plate for the equatorial ring previously described because such a shape can avoid much machining. After casting, the D.C. cast plate is homogenized at a temperature greater than 1020° F but less, preferably 10° less, than the melting point of the alloy for a period greater than 12 hours, preferably greater than 20 hours. Thermal treatment periods beyond 48 hours are not usually necessary, although such extended treatment times do not detrimentally affect the plate properties. For optimum properties, the homogenization should be conducted at a temperature between about 1020° and 1070° F. Heat-up rates to homogenization temperature do not appear critical, except that at plate temperatures above 800° F, the heat-up rate should not exceed 75° F per hour to avoid localized eutectic melting in the plate.

The process of the invention is applicable to Al-Mg alloys containing from about 3.0 to about 6.0% magnesium and silicon from about 0.05 to 0.50%. The ratio of magnesium to manganese should be greater than 3:1, preferably greater than 5:1. Suitable alloys are shown in the table below.

| | Composition Per Cent[1] | | | | | | | |
|---|---|---|---|---|---|---|---|---|
| | Si | Fe | Cu | Mn | Mg | Cr | Zn | Al[2] |
| Broad | 0.5 | 0.5 | 0.3 | 1.0 | 3.0–6.0 | 0.4 | 0.4 | Bal |
| Narrow | 0.2 | 0.3 | 0.2 | 0.3–1.0 | 3.8–5.5 | 0.3 | 0.25 | Bal |
| 5083 | 0.4 | 0.4 | 0.1 | 0.4–1.0 | 4.0–4.9 | 0.05–0.25 | 0.25 | Bal |

[1]Alloy composition is shown as a maximum unless designated as a range
[2]Balance includes aluminum and other elements less than 0.10% each unless noted otherwise The cast plate which has been treated in the manner of the invention will consistently have tensile strengths in excess of 35,000 psi and an elongation in excess of 12% (in 2 inches) in all directions, including short transverse direction. Most importantly, butt weldments of such thick plate consistently pass the weld bend test ($3\frac{5}{8}$ *t* radius) and also fully meet the tensile property requirements set forth in the appropriate ASME specifications.

The Al-Mg alloy of the invention, as with essentially all commercially available aluminum alloys, contains small quantities of silicon as an impurity. When the alloy solidifies during casting, the silicon combines with magnesium to form the intermetallic compound $Mg_2Si$. In the center section of the ingot where solidification rates are relatively slow, the $Mg_2Si$ precipitates preferentially at the grain boundaries, and, if the silicon levels are above 0.05% and the magnesium content is above 3%, the $Mg_2Si$ precipitates as a coarse, script-like eutectic network at the grain boundaries. Homogenization in accordance with the present invention dissolves some of the $Mg_2Si$ eutectic into the aluminum matrix but, due to the high magnesium levels of the alloy, all of the $Mg_2Si$ eutectic cannot be brought into solid solution. However, any remaining undissolved $Mg_2Si$ is transformed from the coarse, script-like form to agglomerated, spherically shaped particles less than 25 microns in maximum dimension. Upon cooling, the dissolved $Mg_2Si$ precipitates from solid solution as small particles which are difficult to resolve by optical microscropy but such small particles usually pose no material problems to tensile properties.

The coarse, script-like $Mg_2Si$ eutectic network at grain boundaries which forms during casting is believed to be a major factor in the weldment bend test failures described in the Background of the Invention. Apparently, welding causes the liquation of the coarse, script-like $Mg_2Si$ in the heat-affected zone of the weldment which results in a weakening of the grain boundaries. Internal stresses develop upon the solidification of the weldment causing initiation of microcracks at sites of microporosity. During the weld bend test, the microcracks propagate along weakened grain boundaries to the weld fusion line. The direction of the microcracks are generally parallel to the tensile test direction, so they have little effect on the tensile test results. However, the microcracks are perpendicular to the bend test direction and apparently result in the bend test failure. By spheroidizing the remaining coarse, script-like $Mg_2Si$ in accordance with the invention, the eutectic is put into an innocuous state which will not weaken the grain boundaries during welding, even though localized melting of the $Mg_2Si$ may occur.

It should be noted that the microcracking is characteristic primarily of the center of the thick cast plate. The solidification during casting is sufficiently rapid at the outer one-fourth t locations to minimize the formation of the coarse, script-like $Mg_2Si$ eutectic along the grain boundaries and this coupled with natural low micropore density in the outer surfaces of the ingot effectively avoids microcracks in the outer surfaces of the cast plate during welding.

Microcracking in the heat-affected zone of the weldment is aggravated by excessive porosity in the base metal so the molten aluminum should be degassed well with chlorine or other fluxing gas prior to casting the cast-to-size ingot. The $H_2$ content of the melt should be less than 0.25 ml/100 grams of metal, preferably less than 0.15 ml/100 grams of metal.

The elimination of silicon from high magnesium aluminum alloys would obviously avoid the problem, but from the practical standpoint, this is difficult because most commercially available aluminum has small quantities of silicon (usually about 0.05 to 0.15%). High purity aluminum can be used to prepare the alloy to avoid the silicon problem but this can be too expensive.

The overall procedures for the present invention, particularly Al-Mg alloys, such as 5083, include preparing a melt of the appropriate composition, degassing the melt to a $H_2$ content of less than 0.25 ml/100 grams of metal, preferably less than 0.15 ml/100 grams of metal, then direct chill casting the alloy into the appropriately sized plate with a relatively slow casting rate, preferably less than 4 inches per minute. After casting, the cast-to-size plate is homogenized at a temperature above 1020° F but below the melting point of the alloy for more than 12, preferably more than 20 hours. A preferred practice consists of homogenizing at a temperature from about 1020°–1070° F for more than 20 hours. Within these time and temperature ranges, the coarse script-like magnesium silicide eutectic which remains preferentially at the grain boundaries at the center of the plate is spheroidized into particles less than 25 microns in maximum dimension, i.e., rendered innocuous. In heating up the plate to homogenizing temperatures, the heat-up rate should not exceed 75° F/hour at plate temperatures about 800° F to avoid localized melting on the surface of the plate. If desired, or necessary, the plate can be subjected to leveling passes in a rolling mill, preferably at normal hot rolling temperatures, but the metallurgical structure must remain essentially unworked, particularly at the center of the plate.

The following examples are given to illustrate advantages and improvements of the invention.

EXAMPLE I

A 5083 aluminum alloy melt was prepared having the following composition:

| Si | Fe | Cu | Mn | Mg | Cr | Zn | Ti | Al |
|---|---|---|---|---|---|---|---|---|
| 0.12 | 0.18 | 0.02 | 0.70 | 4.72 | 0.11 | 0.003 | 0.014 | Bal |

The melt was thoroughly mixed and then fluxed with chlorine gas to a hydrogen level of 0.20 ml/100 grams of metal. The metal was D.C. cast at a rate of about 3 inches per minute into ingot 8 × 28 inches in cross section. One section of the ingot was homogenized at 1050° F for 24 hours in accordance with the present invention, another section at 1000° F for 10 hours, another section at 975° F for 10 hours and another section at 750° F for 4 hours. This latter homogenizing procedure had previously been found to give optimum tensile properties in all directions. The short transverse tensile properties of the various specimens at the one-half t location are set forth below.

| Homogenization Treatment | | ST Tensile Properties - ½ t | | |
|---|---|---|---|---|
| Temp, ° F | Time,hr | TS,ksi | YS,ksi | Elong,% in 2" |
| 750 | 4 | 39.6 | 18.1 | 19 |
| 975 | 10 | 39.1 | 16.1 | 12 |
| 1050 | 10 | 39.5 | 16.3 | 14–15 |
| 1050 | 24 | 39.2 | 16.2 | 15 |

One-inch thick slab specimens were cut from one-fourth t and one-half t locations of each of the ingot sections. Each of the specimen slabs was cut into two parts, then V butt welded with an inert gas shielded consumable electrode arc (GMA welding) under normal welding conditions. The tensile properties of the weldment for specimens where the parent cast plate was homogenized at 1050° F for 24 hours and 750° F for 4 hours are set forth below:

| Parent D.C. Cast Plate Homogenization Treatment | Specimen Location | Tensile Properties of 1-inch Thick Weldments | | |
|---|---|---|---|---|
| | | TS,ksi | YS,ksi | Elong,% in 2" |
| 1050° F, 24 hrs | ½ t | 39.6 | 18.2 | 15.0 |
| | ¼ t | 40.8 | 18.4 | 16.0 |
| 750° F, 4 hrs | ½ t | 33.8 | 19.6 | 9.5 |
| | ¼ t | 35.4 | 20.0 | 11.0 |

Welded specimens (one-half *t*) from plate homogenized at 1050° F for 24 hours consistently passed the bend test (3⅝ *t* bend radius), whereas, welded specimens (one-half *t*) from plate homogenized at 750° F for 4 hours consistently failed the bend test. Welded specimens (one-half *t*) from plate homogenized at 1050° F for 10 hours could not consistently pass the bend test. All one-fourth *t* specimens passed the bend test.

In addition to consistently passing the bend test, the weld specimens from plate homogenized in accordance with the invention has high yield strength and elongation. These high mechanical properties appeared contrary to prior experimentation which indicated that optimum strength and elongation were obtained by homogenizing at 750° F for 4 hours and that homogenizing above 750° F tended to lower yield strength and elongation, particularly by the latter as shown by the specimen homogenized at 975° F for 10 hours.

EXAMPLE II

A 12 inch thick 5083 alloy plate was cast directly to size in the manner described above, homogenized at 1050° F for 24 hours and then cut into two pieces and prepared for welding. The two pieces were butt welded with a V-shaped groove using conventional GMA (MIG) welding procedures. The filler wire was 5083 alloy and one-sixteenth inch in diameter. Approximately 275 passes were needed to completely fill the groove. Specimens were cut for tensile testing and bend tests. The transverse tensile properties across the weld were as follows:

| | UTS ksi | YS ksi | % Elong in 2" |
|---|---|---|---|
| Weldment | 41.0–38.9 | 17.0–19.0 | 16.3–21.9 |
| Parent Plate | 39.6 | 15.4 | 23 |

The values for the parent plate were included for purposes of comparison. Specimens along the entire thickness of the weldment were subjected to the bend test with 3⅓ *t* bend radium and passed.

A homogenizing practice was described in Examples I and II of U.S. Pat. No. 3,347,714 (in which the present inventor was a co-inventor) wherein the homogenizing temperatures were 1025° F and 1000° F, respectively. However, the alloys homogenized were 5457 and 5252, respectively, and as such have less magnesium and silicon than the 5083 type alloys of the present invention. Having lower silicon levels (0.08 max) the 5457 and 5252 alloys have less $Mg_2Si$ formed and because lower magnesium levels allow for the dissolution of more $Mg_2Si$ into the aluminum matrix, these alloys have essentially no tendency to form coarse, script-like $Mg_2Si$ eutectic as do the 5083 type alloys of the invention.

Additionally it should be noted that most commercial homogenizing temperatures for Al-Mg alloys are generally inversely related to the magnesium content, i.e. the lower the magnesium content the higher the homogenizing temperature, subject to an upper temperature limitation due to large grain growth. However, small additions of manganese and the like can minimize grain growth.

It is obvious that various modifications and improvements can be made to the invention without departing from the spirit thereof or the scope of the appended claims.

What is claimed is:

1. An essentially unworked aluminum alloy plate at least 6 inches thick formed from an aluminum alloy consisting essentially of about 3.8–6.0% magnesium, up to 1.0% manganese, silicon as an impurity or as an alloying addition in amounts greater than 0.05% but less than 0.50%, less than 0.50% iron, less than 0.3% copper, less than 0.4% chromium, less than 0.4% zinc and the balance aluminum and inconsequential amounts of other elements, said plate having been D.C. cast directly to size and characterized by having coarse, script-like $Mg_2Si$ eutectic which forms during casting and then said plate having been homogenized at a temperature between about 1020° F and about 1070° F for at least 12 hours to dissolve part of the coarse, script-like $Mg_2Si$ eutectic into the aluminum matrix and transform the remaining coarse, script-like $Mg_2Si$ eutectic to an agglomerated, spherically shaped constituent having a particle size less than 25 microns in maximum dimension, and said plate characterized by exhibiting after fusion welding essentially no microcracks in the heat-affected zone of the plate which forms during welding due to the existence of coarse, script-like $Mg_2Si$ eutectic which forms during casting.

2. The aluminum plate of claim 1 wherein the weight ratio of magnesium to manganese is greater than 3:1.

3. The aluminum plate of claim 1 wherein the weight ratio of magnesium to manganese is greater than 5:1.

4. The aluminum plate of claim 1 wherein the aluminum alloy consists essentially of 3.8–5.5% magnesium, about 0.3–1.0% manganese, less than 0.2% silicon, less than 0.3% iron, less than 0.2% copper, less than 0.3% chromium, less than 0.25% zinc and the balance aluminum and inconsequential amounts of other elements where the weight ratio of magnesium to manganese is greater than 5:1.

5. The aluminum plate of claim 4 wherein said aluminum alloy contains 4.0–4.9% by weight magnesium.

6. A method of preparing an essentially unworked aluminum alloy plate at least 6 inches thick which exhibits essentially no microcracks in the heat-affected zone of said plate when fusion welded due to the existence of coarse, script-like $Mg_2Si$ eutectic which forms during casting comprising the steps of (a) preparing a molten aluminum alloy consisting essentially of about 3.8–6.0% magnesium, up to 1.0% manganese, silicon as an impurity or an alloying addition in amounts greater than 0.05% but less than 0.50%, less than 0.50% iron, less than 0.3% copper, less than 0.4% chromium, less than 0.4% zinc and the balance aluminum and inconsequential amounts of other elements, (b) D.C. casting the molten alloy directly to the desired plate size at least 6 inches thick, said plate having coarse, script-like $Mg_2Si$ eutectic which forms during casting, and (c) homogenizing the D.C. cast aluminum alloy plate at a temperature between about 1020° F and about 1070° F for at least 12 hours, said homogenization dissolving part of the coarse, script-like $Mg_2Si$ eutectic into the aluminum matrix and transforming the remaining coarse, script-like $Mg_2Si$ eutectic to an agglomerated, spherically shaped constituent having a particle size less than 25 microns in maximum dimension.

7. The method of claim 6 wherein said aluminum alloy consists essentially of 3.8–5.5% magnesium, 0.3–1.0% manganese, less than 0.2% silicon, less than 0.3% iron, less than 0.2% copper, less than 0.3% chromium, less than 0.25% zinc and the balance aluminum and inconsequential amounts of other elements, where the ratio of magnesium to manganese is greater than 5:1.

8. The method of claim 6 wherein said molten aluminum alloy is degassed with chlorine or other fluxing gas to a hydrogen level less than 0.25% ml/100 grams of metal prior to casting.

9. The method of claim 6 wherein said D.C. cast plate is homogenized at a temperature between 1020°–1070° F for at least 20 hours.

10. A weldment formed from the aluminum plate of claim 1 exhibiting essentially no microcracking in the heat-affected zone of the weldment due to the presence of coarse, script-like eutectic in the aluminum plate.

11. The aluminum plate of claim 1 wherein the plate has been homogenized at a temperature between 1020°–1070° F for at least 20 hours.

12. The method of claim 6 wherein the plate heat-up rate between 800° F and the homogenizing temperature is less than 75° F/hour.

13. The aluminum plate of claim 1 wherein the homogenization temperature is at least 10° F less than the melting point of the alloy.

14. The aluminum plate of claim 1 wherein the silicon is less than 0.10%.

15. The method of claim 8 wherein the metal is degassed to a hydrogen level less than 0.15 ml/100 grams of metal prior to casting.

16. The aluminum plate of claim 1 at least 8 inches thick.

* * * * *

UNITED STATES PATENT AND TRADEMARK OFFICE

CERTIFICATE OF CORRECTION

PATENT NO. : 4,108,688

DATED : August 22, 1978

INVENTOR(S) : Irwin Broverman

It is certified that error appears in the above-identified patent and that said Letters Patent are hereby corrected as shown below:

Column 1, line 25, "≡inches" should be --5 inches--

Column 2, line 63, "(3-5/8" should be --(3-1/3--

Column 4, line 18, "about 800°F" should be --above 800°F--

Column 4, line 40, "into ingot" should be --into an ingot--

Column 5, line 12, "(3-5/8" should be --(3-1/3--

Column 5, line 26, "particularly by the latter" should be --particularly the latter--

Signed and Sealed this

*First* Day of *May 1979*

[SEAL]

*Attest:*

RUTH C. MASON
*Attesting Officer*

DONALD W. BANNER
*Commissioner of Patents and Trademarks*